US009981721B2

(12) United States Patent
Deurr et al.

(10) Patent No.: US 9,981,721 B2
(45) Date of Patent: May 29, 2018

(54) PONTOON BOAT

(71) Applicant: PREMIER MARINE, INC., Wyoming, MN (US)

(72) Inventors: John Deurr, Stacy, MN (US); David Grovender, North Branch, MN (US)

(73) Assignee: Premier Marine, Inc., Wyoming, MN (US)

( * ) Notice: Subject to any disclaimer, the term of this patent is extended or adjusted under 35 U.S.C. 154(b) by 60 days.

(21) Appl. No.: 14/813,954

(22) Filed: Jul. 30, 2015

(65) Prior Publication Data

US 2017/0029069 A1 Feb. 2, 2017

(51) Int. Cl.

| | |
|---|---|
| ***B63B 35/38*** | (2006.01) |
| ***B63B 29/02*** | (2006.01) |
| ***B63B 1/20*** | (2006.01) |
| ***B63B 1/12*** | (2006.01) |
| *B63B 35/613* | (2006.01) |
| *B63B 1/18* | (2006.01) |

(52) U.S. Cl.

CPC ..... *B63B 29/02* (2013.01); *B63B 1/125* (2013.01); *B63B 1/20* (2013.01); *B63B 35/38* (2013.01); *B63B 35/613* (2013.01); *B63B 2001/186* (2013.01)

(58) Field of Classification Search

CPC ..... B63B 7/04; B63B 1/125

See application file for complete search history.

(56) References Cited

U.S. PATENT DOCUMENTS

| | | | | | |
|---|---|---|---|---|---|
| 1,064,472 | A * | 6/1913 | Schleicher | B63C 9/06 | 114/259 |
| 1,076,068 | A * | 10/1913 | Haas | B63B 9/04 | 114/352 |
| 4,092,754 | A | 6/1978 | Yost | | |
| 4,425,861 | A * | 1/1984 | Raikamo | B63B 29/02 | 114/202 |
| 4,685,411 | A * | 8/1987 | Wick | B63B 19/02 | 114/202 |
| 4,729,334 | A * | 3/1988 | DeJean, Jr. | B63B 35/14 | 114/255 |
| 5,029,348 | A * | 7/1991 | Boren | B63B 15/00 | 4/312 |
| 5,143,013 | A * | 9/1992 | Huebner | B63B 29/04 | 114/343 |
| 5,209,177 | A | 5/1993 | Granie et al. | | |
| D341,566 | S * | 11/1993 | Brooks | B63B 29/02 | D12/310 |
| 5,435,260 | A * | 7/1995 | Granie | B63B 1/12 | 114/290 |
| 5,522,333 | A * | 6/1996 | Lang | B63B 1/107 | 114/274 |
| 5,529,009 | A * | 6/1996 | Faury | B63B 1/125 | 114/123 |
| 6,701,863 | B2 * | 3/2004 | Kalhok | B63B 17/02 | 114/343 |
| 6,729,258 | B1 * | 5/2004 | Fuglsang | B63B 1/125 | 114/274 |

(Continued)

*Primary Examiner* — Lars A Olson
*Assistant Examiner* — Jovon Hayes
(74) *Attorney, Agent, or Firm* — Shumaker & Sieffert, P.A.

(57) ABSTRACT

The instant disclosure pertains to a pontoon boat having various embodiments of an enclosure. Non-limiting exemplary embodiments of the enclosure are configured for habitation.

28 Claims, 8 Drawing Sheets

(56) References Cited

U.S. PATENT DOCUMENTS

| | | | | | |
|---|---|---|---|---|---|
| D516,495 | S * | 3/2006 | Menne | B63B 29/02 | D12/300 |
| D520,441 | S * | 5/2006 | Guvenc | B63B 29/04 | D12/300 |
| 7,040,248 | B1 * | 5/2006 | Whitfield | B63B 29/04 | 104/45 |
| 7,117,646 | B2 * | 10/2006 | Blaisdell | B63B 17/00 | 52/79.5 |
| 7,950,340 | B1 * | 5/2011 | Curtis | B63B 1/20 | 114/61.1 |
| 8,944,867 | B2 * | 2/2015 | Grovender | B63H 20/02 | 248/641 |
| 9,403,581 | B2 * | 8/2016 | Kalil | B63B 29/02 | |
| 9,475,548 | B1 * | 10/2016 | Slocum | B63B 1/125 | |
| 2004/0266282 | A1 * | 12/2004 | Hahn | B63B 3/48 | 440/77 |
| 2009/0120341 | A1 | 5/2009 | Kalil | | |
| 2011/0197800 | A1 | 8/2011 | Kalil | | |
| 2015/0013585 | A1 | 1/2015 | Kalil | | |
| 2015/0232151 | A1 * | 8/2015 | Fuller, IV | B63B 19/18 | 114/117 |

* cited by examiner

PONTOON BOAT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The instant disclosure relates to pontoon boats, and more particularly, to a habitable enclosure, e.g., a cuddy cabin, therefor.

BACKGROUND

Pontoon boats typically include a deck extending between a pair of spaced-apart and substantially parallel pontoons, with a helm, seats, furniture, etc., within a fenced area atop the deck, and one or more propulsion means. In general, pontoon boats do not include any enclosed areas providing privacy over an extended period of time and/or protection from the weather.

Accordingly, there exists a need for a habitable enclosure, e.g., a cuddy cabin, for pontoon boats.

SUMMARY

A pontoon boat including a pair of spaced-apart and substantially parallel pontoons secured to a deck disposed between the pontoons, and a hull secured to the deck and disposed substantially parallel to the pair of pontoons. In accordance with a non-limiting exemplary embodiment, the pontoon boat includes an enclosure having an upper section extending upwardly from a topside of the deck and a lower section having at least a portion thereof extending through an opening the deck and into at least a portion of the hull extending underneath the deck. The enclosure further includes a doorway. The pontoon boat further includes one or more propulsion systems and a helm.

A flotation system including a pair of spaced-apart and substantially parallel pontoons secured to a deck disposed between the pontoons, and a hull secured to the deck and disposed substantially parallel to the pair of pontoons. The pontoons and the hull are configured as an integrated system wherein a volume of water displaced by the hull is greater than a volume of water displaced by either one or both pontoons.

DETAILED DESCRIPTION

One or more non-limiting embodiments are described herein with reference to the accompanying drawings, wherein like elements are designated by like numerals. It should be clearly understood that there is no intent, implied or otherwise, to limit the disclosure in any way, shape or form to the illustrated and described embodiments. While multiple exemplary embodiments are described, variations thereof will become apparent or obvious. Accordingly, any and all variants for providing functionalities similar to those of the described embodiments are considered as being within the metes and bounds of the instant disclosure.

Figure 1:
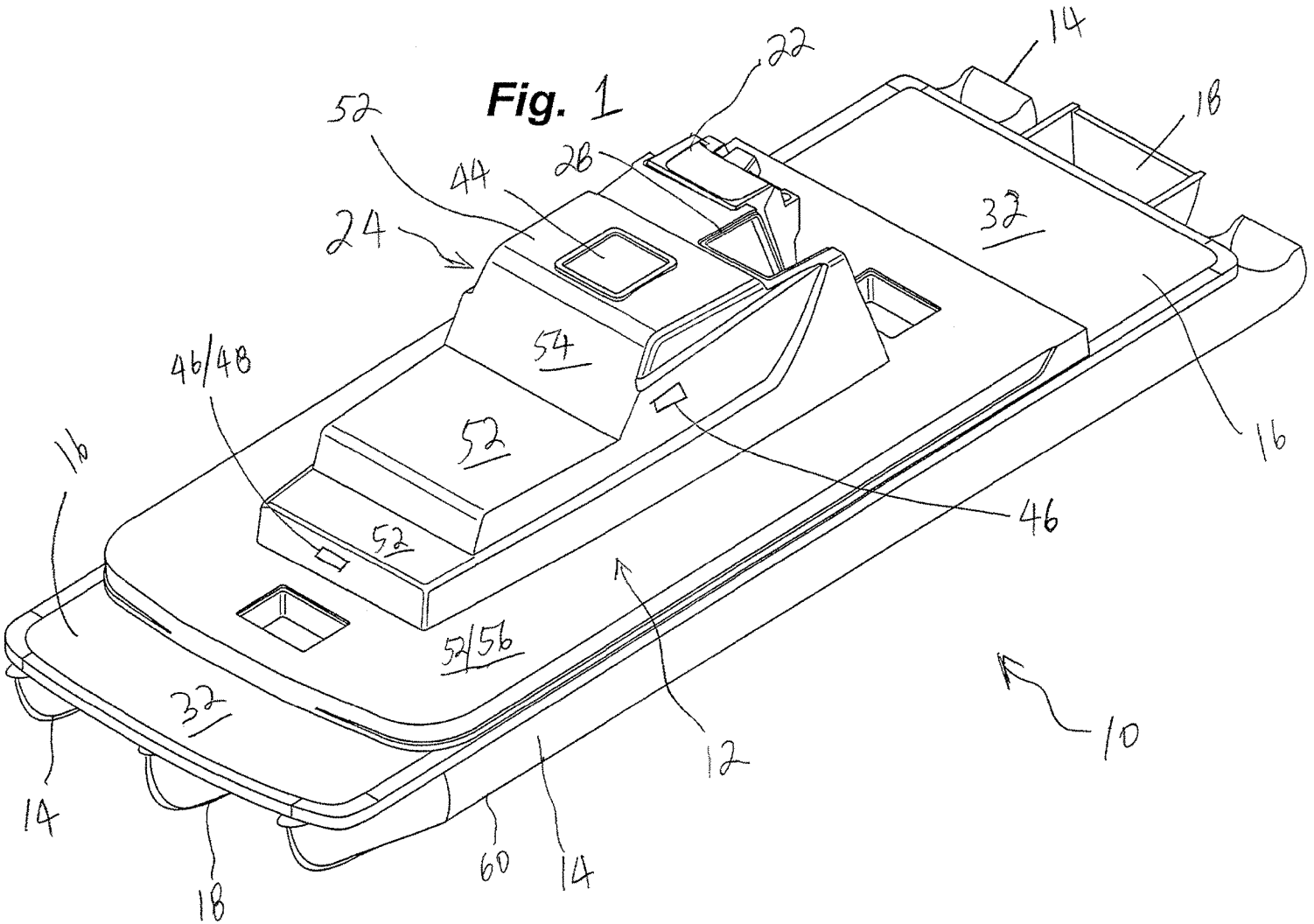
FIG. 1 is a perspective view of a non-limiting exemplary embodiment of a pontoon boat as viewed from a front corner.
Figure 2:
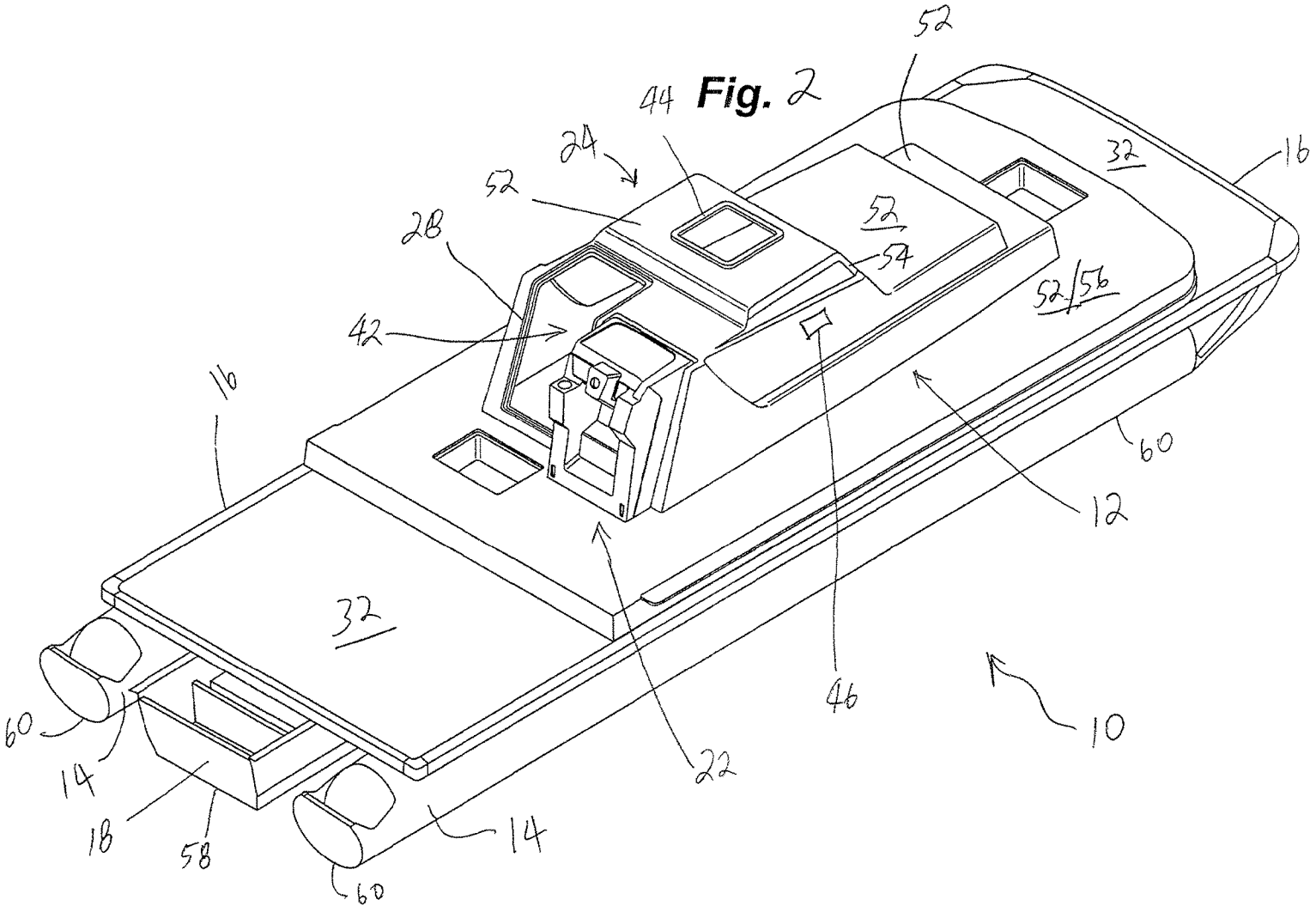
FIG. 2 is a perspective view of the pontoon boat of FIG. 1 as viewed from an opposite corner.
Figure 3:
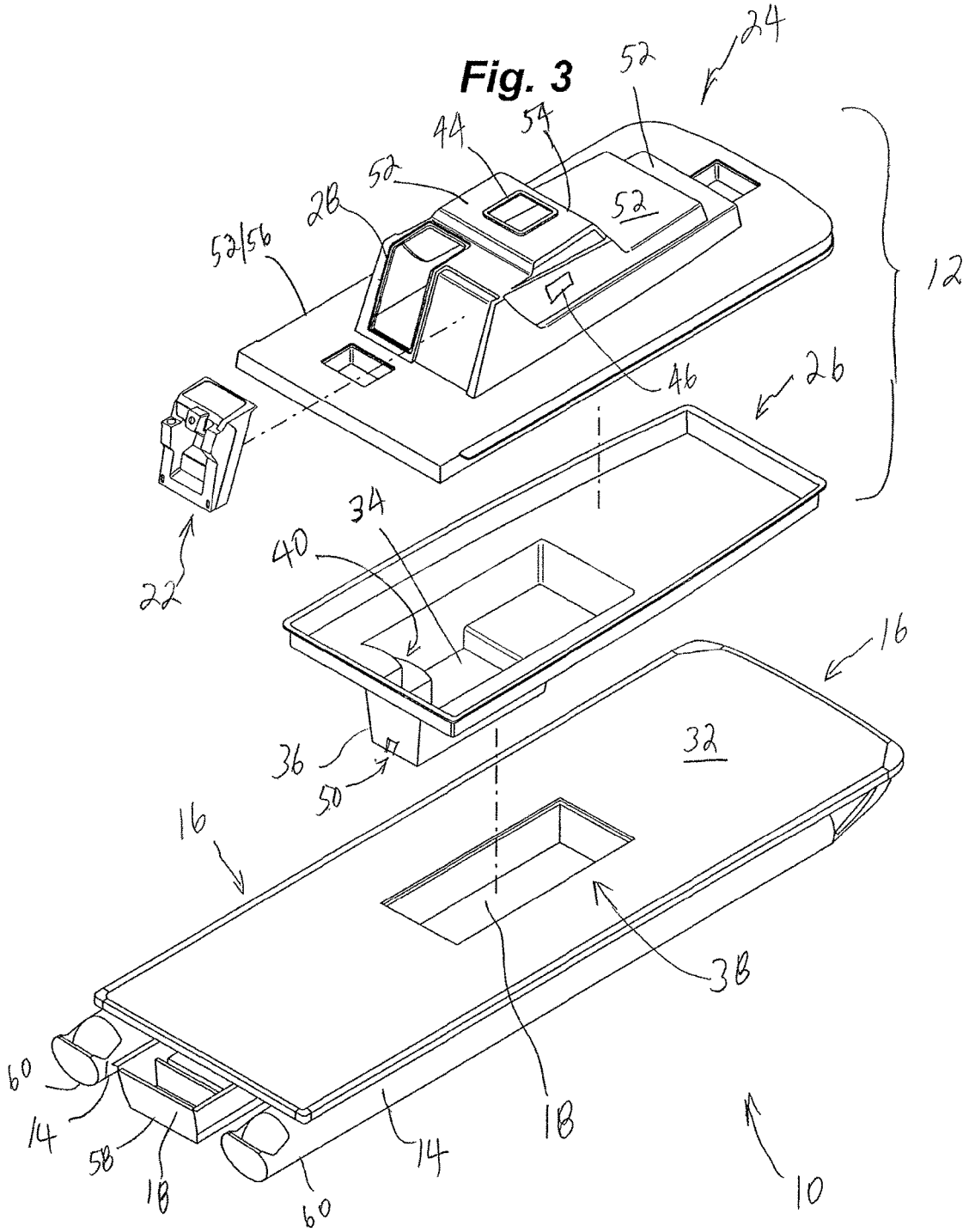
FIG. 3 is a perspective view of a partially un-assembled pontoon boat of FIG. 2 illustrating a physical relationship between some of the primary components.
Figure 4:
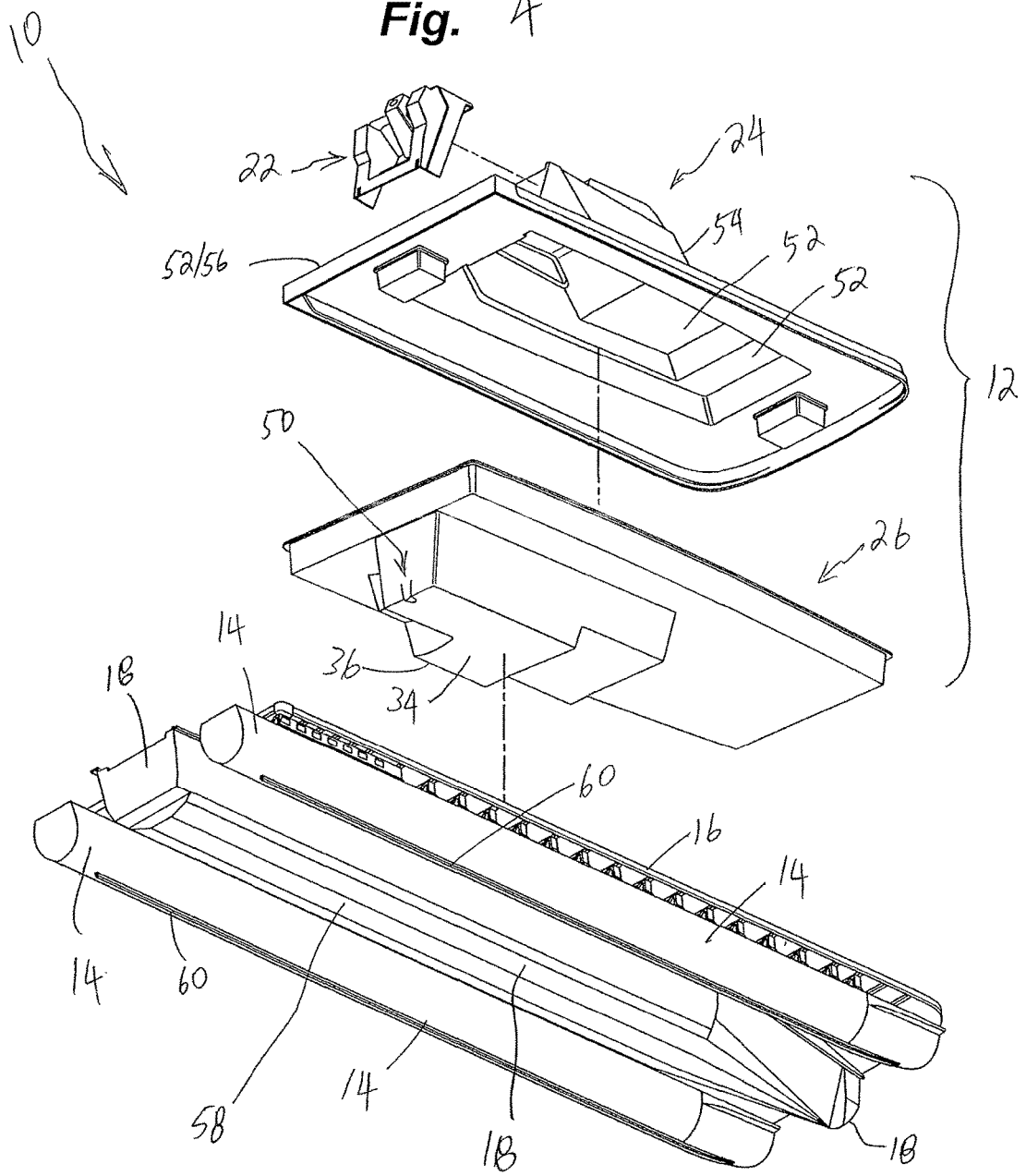
FIG. 4 is a perspective view of the partially un-assembled pontoon boat of FIG. 3 as viewed from below.
Figure 5:
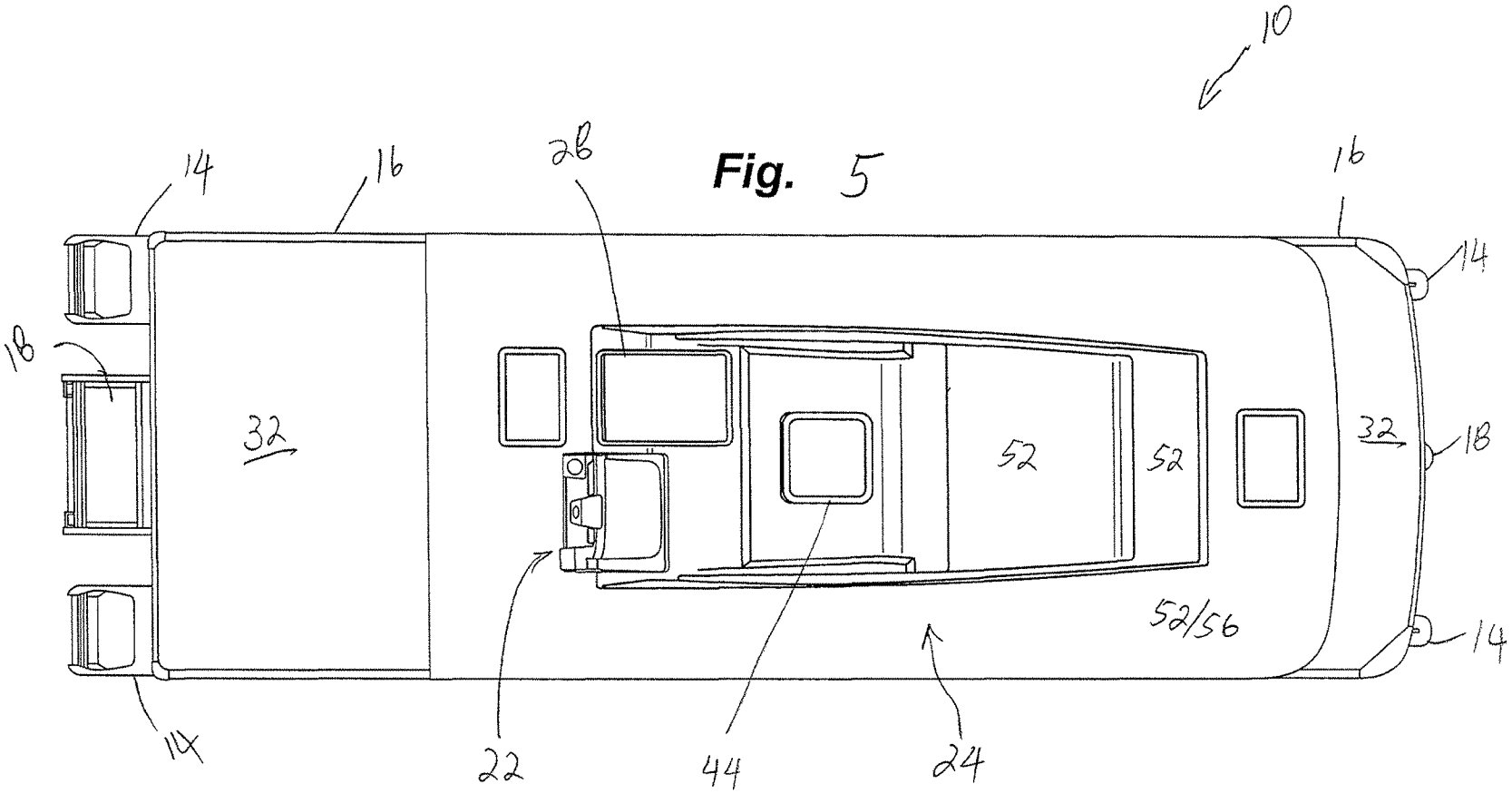
FIG. 5 is a plan view of the pontoon boat of FIG. 2 as viewed from above.
Figure 6:
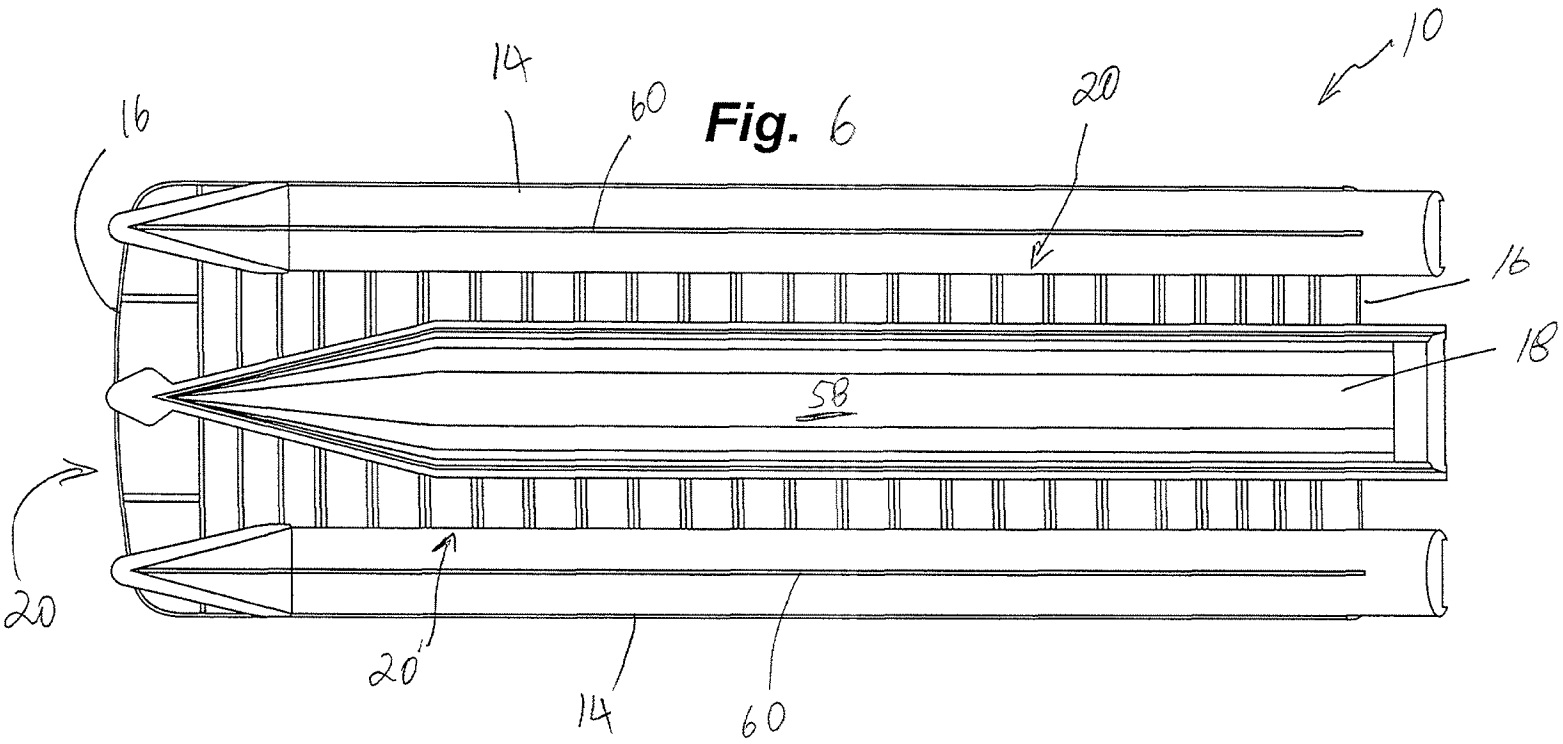
FIG. 6 is a plan view of the pontoon boat of FIG. 2 as viewed from underneath.
Figures 7, 8:
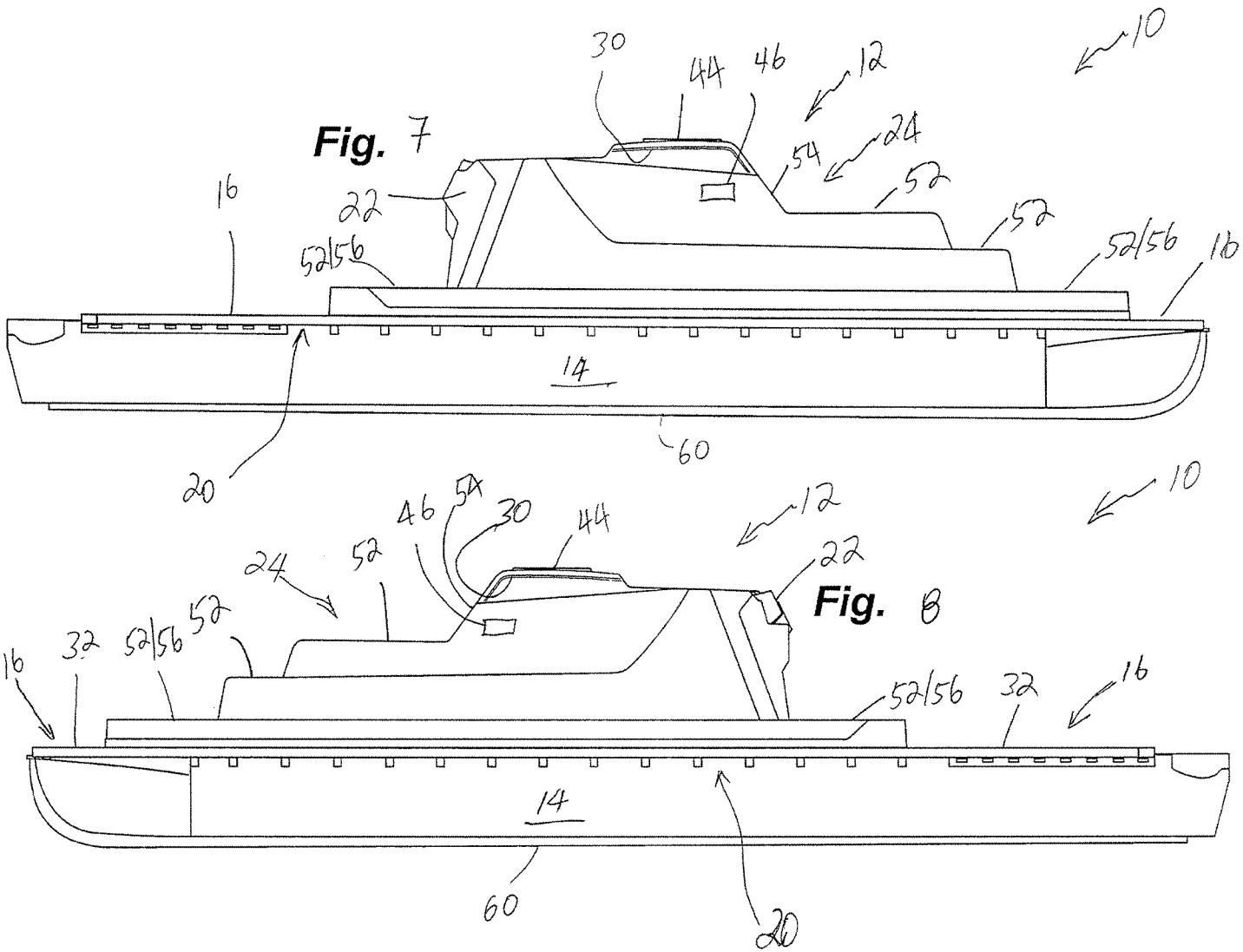
FIG. 7 is an elevation of the pontoon boat of FIG. 2 as viewed from the right (starboard)
FIG. 8 is an elevation of the pontoon boat of FIG. 2 as viewed from the left (port)
Figure 9:
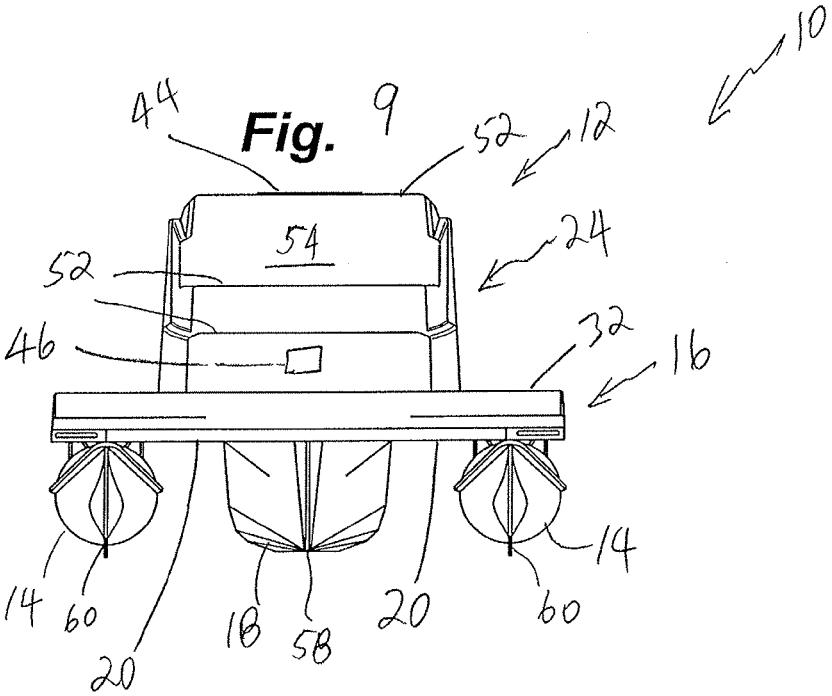
FIG. 9 is an elevation of the pontoon boat of FIG. 2 as viewed from the front (fore or bow)
Figure 10:
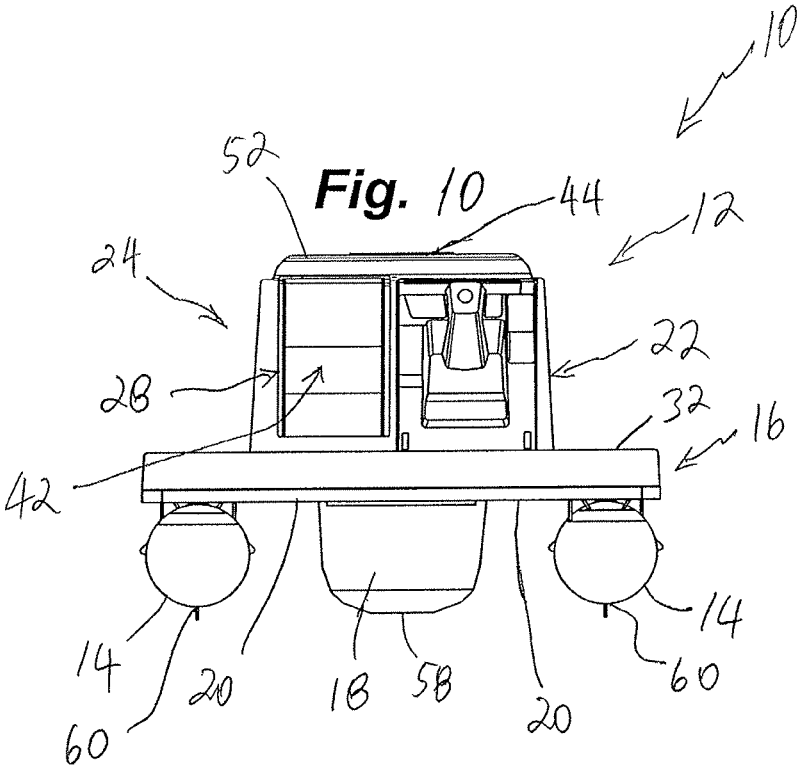
FIG. 10 is an elevation of the pontoon boat of FIG. 2 as viewed from the rear (aft or stern).

FIGS. 1 and 2 are perspective views from opposite corners of a non-limiting exemplary embodiment of pontoon boat 10 having an enclosure 12; FIGS. 3 and 4, respectively, are perspective views of partially un-assembled pontoon boat 10 as viewed from above and from below; FIGS. 5 and 6, respectively, are plan views of pontoon boat 10 as viewed from above and from underneath; FIGS. 7 and 8, respectively, are elevations of pontoon boat 10 as viewed from the starboard, i.e., right, side and from the port, i.e., left, side; and FIGS. 9 and 10, respectively, are elevations of pontoon boat 10 as viewed from the fore or bow, i.e., front, and from the aft or stern, i.e., rear.

Pontoon boat 10 includes a pair of spaced apart and substantially parallel pontoons 14 secured to a deck 16, and a hull 18 extending from an underside 20 of deck 16. Typically, hull 18 is substantially parallel to and equidistant from each pontoon 14. Pontoon boat 10 also includes a helm 22 configured with controls for operating and navigating boat 10 and for operating one or more accessories, e.g., lights, audio, video, beacons, etc. Although not shown, it should be apparent that pontoon boat 10 will include one or more propulsion systems for moving the boat through water. In some embodiments, the one or more propulsion systems may include at least one outboard motor or at least one inboard motor or a jet powered or a combination thereof. In certain embodiments, the one or more propulsion systems may include propellers and/or impellers.

In a non-limiting exemplary embodiment, enclosure 12 includes an upper section 24, a lower section 26, a doorway 28 and a ceiling 30 defined by a portion of upper section 24. In some embodiments, upper section 24 is disposed on and extends upwardly away from a topside 32 of deck 16. In an exemplary embodiment, at least a portion of lower section 26 extends through an opening 38 in deck 16 into at least a portion of hull 18. In certain embodiments, a bottom of the lower section extending into the hull defines a floor 34 of enclosure 12. In some embodiments, at least a portion of hull 18 extends underneath deck 16. In certain embodiments, enclosure 12 includes one or more steps 40 between doorway 28 and floor 34 that may be used for entering and exiting enclosure 12.

In a non-limiting exemplary embodiment, enclosure 12 includes a headroom, i.e., distance between ceiling 30 and floor 34, for at least one adult standing upright. In some embodiments, at least a portion of lower section 26 not extending into hull 18 is supported at least in part by at least a portion of deck 16. In certain embodiments, at least a portion of lower section 26 not extending into hull 18 is supported at least in part by topside 32 of deck 16. In certain embodiments, at least a portion of hull 18 at least partially supports the portion of lower section 26 that does not extend into hull 18.

In an exemplary embodiment, enclosure 12 weatherproofs an interior 42 thereof. As such, enclosure 12 may be configured for habitation. In some embodiments, interior 42 of enclosure 12 has a headroom for at least one adult standing upright on floor 34. In certain embodiments, enclosure 12, i.e., habitable interior 42, may be furnished with one or more bunks, one or more benches, a dinette, a galley, a head, a shower stall or area, a privacy stall or area for changing, etc. In certain embodiments, enclosure 12 may include only some, but not all, of the listed exemplary furnishings. In some embodiments, enclosure 12 may include all of the listed exemplary furnishings. In certain embodiments, enclosure 12 includes one or more skylights and/or hatchway 44, one or more windows 46, one or more openings 48 for ventilation, etc. Enclosure 12 may also include one or more openings 50 for draining liquid from interior 42.

In a non-limiting exemplary embodiment, enclosure 12 includes one or more platforms 52 disposed on an exterior of upper section 24. In some embodiments, enclosure 12 may include a backrest 54 extending from one or more platforms 52. In certain embodiments, one or more platforms 52 may be configured as a bed, a lounge chair, a bench, etc. In an exemplary embodiment, pontoon boat 10 may include comfort furnishings such as cushion(s), mattress, etc., disposed on one or more platforms 52 and/or backrest 54.

In a non-limiting exemplary embodiment, pontoon boat 10 includes a platform 56 disposed on topside 32 of deck 16 with upper section 24 disposed on and extending upwardly away from platform 56. In some embodiments, lower section 26 extends through an opening in platform 56 and is disposed on at least a portion of topside 32 covered by platform 56.

In an exemplary embodiment, at least a portion of or the entirety of lower section 26 is recessed into deck 16. In another exemplary embodiment, at least a portion of or the entirety of lower section 26 extends through an opening in deck 16. In yet another exemplary embodiment, at least a portion of or the entirety of lower section 26 extends through an opening in deck 16 and into at least a portion of hull 18.

In an exemplary embodiment, at least a portion of or the entirety of upper section 24 is disposed on or attached to at least a portion of lower section 26 and extends upwardly away from lower section 26. In another exemplary embodiment, at least a portion of or the entirety of upper section 24 is disposed on or attached to the entirety of lower section 26 and extends upwardly away from lower section 26.

In an exemplary embodiment, at least a portion of or the entirety of upper section 24 extends through deck 16 and is disposed on or attached to at least a portion of hull 18 and extends upwardly away from hull 18. In another exemplary embodiment, at least a portion of or the entirety of upper section 24 extends through deck 16 and is disposed on or attached to the entirety of hull 18 and extends upwardly away from hull 18.

In an exemplary embodiment, at least a portion of or the entirety of hull 18 is configured similar to or substantially the same as at least a portion of lower section 26. In another exemplary embodiment, at least a portion of or the entirety of hull 18 is configured similar to or substantially the same as the entirety of lower section 26.

In a non-limiting exemplary embodiment, the pair of parallel pontoons 14 and hull 18 are configured as an integrated system that emulates a mono hull of a watercraft as is well known to the skilled artisan. In some embodiments, pontoons 14 and hull 18 have complementary designs and are integrated in a manner whereby pontoon boat 10 functions, operates and performs substantively similar in characteristics to an agile and highly stable watercraft having a mono hull. As is well known in the art, a mono hull enhances several characteristics of a watercraft, including and not limited to: buoyancy, structural integrity, stability, agility, maneuverability, steering, handling, load carrying capacity, and hydroplaning. In some embodiments, the emulated mono hull is a V-shaped hull as is well known in the art. In some embodiments, pontoons 14 and/or hull 18 may include one or more lifting strakes on their respective exterior surfaces. In certain embodiments, the one or more lifting strakes enhance the hydroplaning characteristics of pontoons 14 and/or hull 18. In some embodiments, the one or more lifting strakes enhance the maneuverability of pontoon boat 10.

In a non-limiting exemplary embodiment, hull 18 is designed and installed such that it submerges deeper into the water than either one or both pontoons 14. Moreover, in certain embodiments, the volume of water displaced by the submerged portion of hull 18 is greater than the volume of water displaced by one and/or both of the parallel pontoons 14. As will be apparent to those skilled in the art, pontoon boats 10 having such configurations can accommodate greater loads than a traditional pontoon boat having only a pair of parallel pontoons and no hull. Alternatively, embodiments may comprise the hull 18 and one or both pontoons 14 submerging an equivalent vertical distance into the water.

In some embodiments, pontoons 14 and hull 18 have substantially circular cross-sections. In certain embodiments, each pontoon 14 has a substantially circular cross-section and hull 18 has a substantially non-circular cross-section. In some embodiments, pontoons 14 and hull 18 have substantially non-circular cross-sections. In certain embodiments, a perimeter of hull 18 in contact with water is greater than a perimeter of either one or both pontoons in contact with water. In some embodiments, bottom 58 of hull 18 has a radius of curvature greater than a radius of curvature of a bottom 60 of either one or both pontoons 14. In certain embodiments, bottom 58 of hull 18 is essentially flat.

In a non-limiting exemplary embodiment, hull 18 is disposed substantially equidistant from both pontoons 14. Accordingly, in some embodiments, both pontoons 14 may be substantially identical. In another non-limiting exemplary embodiment, hull 18 is not equidistant from both pontoons 14. For example, hull 18 may be disposed closer to one of the pontoons 14 and therefore farther from the other of pontoons 14. Accordingly, in some embodiments, pontoons 14 may be configured substantially different from each other. For instance, in certain embodiments, a perimeter of one pontoon 14 may be larger or smaller than a perimeter of the other pontoon 14. In some embodiments, a cross-section of one pontoon 14 may be larger or smaller than a cross-section of the other pontoon 14. In certain embodiments, hull 18 may be configured substantially similar to substantially identical pontoons 14. For example, hull 18 and the substantially identical pontoons 14 may have substantially similar cross-sections. In some embodiments, hull 18 may be configured substantially different from substantially identical pontoons 14. For example, the cross-section of hull 18 may be substantially different from the cross-sections of substantially identical pontoons 14. In certain embodiments, hull 18 may be configured substantially similar to one of the pontoons 14 and substantially different from the other pontoon 14. For example, the cross-section of hull 18 may be substantially similar to the cross-section of one of the pontoons 14 and substantially different from the cross-section of the other pontoon 14. Variant, additional and/or alternate configurations for one or both pontoons 14 and hull 18 are considered as being within the metes and bounds of the instant disclosure.

In a non-limiting exemplary embodiment, pontoon boat 10 is defined by a flotation system configured in the manner described herein. In some embodiments, the flotation system is a barge. In certain embodiments, the flotation system is watercraft configured for being towed.

In view thereof, modified and/or alternate embodiments of device 10, and of enclosure 12 in particular, may become apparent or obvious. Any and all such variants are considered as being within the metes and bounds of the instant disclosure. For instance, while reference may have been made to particular features and/or functions, the disclosure is considered to also include embodiments configured for functioning and/or providing functions same as or substantially similar to those disclosed herein. Accordingly, any and all such variants are considered encompassed within and embraced by the spirit, scope and intent of the instant disclosure. The metes and bounds of the disclosure is defined by the appended claims and any and all equivalents thereof.

What is claimed is:

1. A pontoon boat, comprising:

a pair of spaced-apart and substantially parallel pontoons secured to a deck disposed therebetween, wherein each one of the pair of pontoons comprises a substantially circular cross-section, and wherein the pontoons are configured to include a submerged portion and an unsubmerged portion, the unsubmerged portion including at least part of the substantially circular cross-section;

a hull secured to the deck and disposed between and substantially parallel to the pair of pontoons, wherein the deck defines an opening extending into at least a portion of the hull underneath the deck, and wherein the hull comprises an essentially flat bottom and essentially flat sides;

an enclosure, comprising:

an upper section extending upwardly away from a topside of the deck;

a lower section having at least a portion thereof extending through the opening defined by the deck and into at least the portion of the hull underneath the deck; and a doorway;

one or more propulsion systems; and a helm.

2. The pontoon boat of claim 1, wherein a bottom of the lower section extending into the hull defines a floor of the enclosure;

a top of the upper section defines a ceiling of the enclosure; and the enclosure further comprises one or more steps between the doorway and the floor.

3. The pontoon boat of claim 2, wherein the enclosure comprises a headroom for at least one adult standing upright.

4. The pontoon boat of claim 1, wherein the hull and the pair of pontoons are integrated as a system that emulates a mono hull.

5. The pontoon boat of claim 1, wherein a volume of water displaced by the hull is greater than a volume of water displaced by either one or both pontoons.

6. The pontoon boat of claim 1, wherein the hull submerges deeper than either one or both pontoons.

7. The pontoon boat of claim 1, wherein a perimeter of the hull in contact with water is greater than a perimeter of one or both pontoons in contact with water.

8. The pontoon boat of claim 1, wherein:

the hull comprises a non-circular cross-section.

9. The pontoon boat of claim 1, wherein a bottom of the hull has a radius of curvature greater than a radius of curvature of a bottom of either one or both pontoons.

10. The pontoon boat of claim 1, further comprising one or more lifting strakes disposed on an exterior surface of the hull and on an exterior surface of one or both pontoons.

11. The pontoon boat of claim 1, wherein the hull and the pair of pontoons are integrated as a system for enhancing one or more of:

buoyancy;

structural integrity;

stability;

agility;

maneuverability;

steering;

handling;

load carrying capacity; and hydroplaning.

12. The pontoon boat of claim 1, wherein at least a portion of the lower section not extending into the hull is supported at least in part by at least a portion of the deck.

13. The pontoon boat of claim 1, wherein the enclosure weatherproofs an interior thereof.

14. The pontoon boat of claim 13, wherein the enclosure comprises at least one of the group consisting of:

one or more bunks;

one or more benches;

lighting;

a dinette;

a galley;

a head;

a shower stall; and a changing stall.

15. The pontoon boat of claim 1, wherein the enclosure comprises at least one of the group consisting of:

a hatchway;

a skylight;

a window; and a ventilation opening.

16. The pontoon boat of claim 1, wherein an exterior of the upper section comprises one or more platforms.

17. The pontoon boat of claim 16, wherein at least one of the one or more platforms comprises a backrest.

18. A flotation system, comprising:

a pair of spaced-apart and substantially parallel pontoons secured to a deck disposed therebetween, wherein each one of the pair of pontoons comprises a substantially circular cross-section, and wherein the pontoons are configured to include a submerged portion and an unsubmerged portion, the unsubmerged portion including at least part of the substantially circular cross-section;

a hull secured to the deck and disposed between and substantially parallel to the pair of pontoons, wherein the deck defines an opening extending into at least a portion of the hull underneath the deck, and wherein the hull comprises an essentially flat bottom and essentially flat sides; and wherein, a volume of water displaced by the hull is greater than a volume of water displaced by either one or both pontoons.

19. The flotation system of claim 18, wherein the hull and the pair of pontoons are integrated as a system that emulates a mono hull.

20. The flotation system of claim 18, wherein a volume of water displaced by the hull is greater than a volume of water displaced by either one or both pontoons.

21. The flotation system of claim 18, wherein the hull submerges deeper than either one or both pontoons.

22. The flotation system of claim 18, wherein:

the hull comprises a non-circular cross-section.

23. The flotation system of claim 18, wherein a bottom of the hull has a radius of curvature greater than a radius of curvature of a bottom of either one or both pontoons.

24. The flotation system of claim 18, further comprising one or more lifting strakes disposed on an exterior surface of the hull and on an exterior surface of one or both pontoons.

25. The flotation system of claim 18, comprising:

one or more propulsion systems; and a helm.

26. The flotation system of claim 18, further comprising an enclosure, comprising:

an upper section extending upwardly away from a topside of the deck;

a lower section having at least a portion thereof extending through the opening defined by the deck and into at least the portion of the hull underneath the deck; and a doorway.

27. The flotation system of claim 26, wherein a bottom of the lower section extending into the hull defines a floor of the enclosure;

a top of the upper section defines a ceiling of the enclosure; and the enclosure further comprises one or more steps between the doorway and the floor.

28. The flotation system of claim 26, wherein the enclosure weatherproofs an interior thereof.

* * * * *